United States Patent [19]

Stewart et al.

[11] 4,203,367

[45] May 20, 1980

[54] LIFT AND LINE BEAM EXTENSION

[75] Inventors: John K. Stewart; Helmuth von Beckmann, both of Columbia, S.C.

[73] Assignee: Canron Corp., Columbia, S.C.

[21] Appl. No.: 34,950

[22] Filed: Apr. 30, 1979

Related U.S. Application Data

[63] Continuation of Ser. No. 663,194, Mar. 1, 1976, abandoned, which is a continuation of Ser. No. 572,707, Apr. 29, 1975, abandoned, which is a continuation-in-part of Ser. No. 397,817, Sep. 17, 1973, abandoned.

[51] Int. Cl.[2] ..... E01B 33/06

[52] U.S. Cl. ..... 104/7 B

[58] Field of Search ..... 104/7 R, 7 B, 8

[56] References Cited

U.S. PATENT DOCUMENTS

| | | | |
|---|---|---|---|
| 3,312,179 | 4/1967 | Stewart | 104/7 R |
| 3,459,136 | 8/1979 | St. John | 104/8 |
| 3,556,010 | 1/1971 | Plasser et al. | 104/7 R |
| 3,659,345 | 5/1972 | Plasser et al. | 104/7 R |

FOREIGN PATENT DOCUMENTS

| | | | |
|---|---|---|---|
| 1407853 | 6/1974 | France | 104/7 R |

*Primary Examiner*—Richard A. Bertsch

*Attorney, Agent, or Firm*—Wenderoth, Lind & Ponack

[57] ABSTRACT

A device for lifting and/or lining railroad track, which device extends longitudinally of the track and is mounted at one end on a truck carrying track engaging wheels, and the other end is adapted to be connected to a propelling vehicle. Reaction blocks are provided on the beam in the region of the other end, and a track position correcting frame is carried between the reaction blocks and the end mounted on the truck and close to the other beam end. The device provides a lifting and/or aligning attachment for, say a tamping machine, which attachment substantially absorbs all its own lifting and/or lining forces and transmits them to the track rather than to the tamping machine. The device also provides a track position reference means to provide information on the displacement of the lifted and/or aligned track.

26 Claims, 10 Drawing Figures

LIFT AND LINE BEAM EXTENSION

This application is a continuation of application Ser. No. 663,194, filed Mar. 1, 1976, which in turn is a continuation of application Ser. No. 572,707, filed Apr. 29, 1975, which in turn is a continuation-in-part application Ser. No. 397,817, filed Sept. 17, 1973, each of which are now abandoned.

BACKGROUND OF THE INVENTION

The present invention relates to a device for shifting a railroad track such as by lifting and/or lining it. Generally speaking, devices for lifting and lining railroad track are associated with tamping machines which consolidate the ballast after the track has been shifted to its new surface and alignment condition. A large number of tamping machines, presently in use, carry track lifting and lining jacks cantilevered in front of the tamping machine, ahead of the tamping heads, and the loading on the axles of the tamping machines when they are performing a correcting lift or line operation, has on occasion been greater than desirable.

One attempt at reducing the loading on the front axle of tamping machines during a track correcting operation has been to provide the tamping machines with a jacking frame with jack shoes which engage the ballast externally of the track, on either side thereof. An example of this type of device is seen in the Stewart U.S. Pat. No. 3,299,833, issued Jan. 24, 1967. There are however, some instances in which it is not either desirable or possible to place ballast engaging jacks on the shoulders of the ballast on either side of the track, and under such conditions the front axle of the machine used have had to bear most of the reaction to the lifting and lining load.

An alternative proposal has been put forward in which the lifting and lining operation is performed on the tamping machine between the axles thereof so that the frame of the machine itself acts as a reaction point and distributes the loading more or less equally on the axles. This solution however, requires that the tamping machine be designed and built from the beginning to this style of design and it is not possible to adapt existing machines to use this solution.

A further suggestion which has been made in order to reduce some of the stresses on the tamping machine during an alignment operation, for a tamping machine in which the tamping heads, lifting jacks and lining jacks are cantilevered ahead of the front axle of the machine (which machine may, or may not, include shoulder engaging lifting jacks) has been to provide an elongated element which extends between the track rails and has thrust exerting means positioned between one of the track rails and the elongated element. In this configuration, one end of the elongated element is pivotally connected to the machine frame and the other end of the elongated element is pivoted and attachably connected to a truck on the track at a point spaced from the machine frame. One of the drawbacks of this solution was that whilst it helped to distribute some of the track aligning forces it did little or nothing to solve the problems caused by the track lifting forces. Furthermore, since the tamping machine itself still physically carried the track lifting and aligning apparatus, the track alignment forces were distributed in a somewhat inefficient manner.

SUMMARY OF THE INVENTION

According to the present invention, a device for lifting and aligning a railroad track comprising a beam member for extending longitudinally of the track, mounted at a first end on track engaging wheels; a second end of said beam; means to connect said second end to a propelling vehicle; a pair of reaction blocks, one for each rail, on said beam member in the region of said second end, each reaction block having an outwardly facing flange for engaging the inner side of a rail head; a track position correcting frame carried by said beam between said reaction blocks and said first end and closer to said reaction blocks than to said first end; said means to connect said second end including means engageable to lift said reaction blocks free of the track for track travel of the beam member. In a preferred embodiment of the invention, the distance, measured transversely of the track, between the outside faces of said flanges is directly related to the track gauge so that the flanges fit snuggly against the inside of the rail heads. Preferably means is provided to clamp the first end of the beam to the track during a track correction operation and in a preferred embodiment this is accomplished by a wedge means insertable between at least one selected flange of the track engaging wheels and the inside of a corresponding rail head. Preferably, the first end of the beam member is mounted on a truck which carries the track engaging wheels, the wedge means being operatively mounted on the truck. Power means may be provided for selectively activating the wedge means.

According to a feature of the invention, a resilient mounting connects the second end of the beam member to the front axle of the propelling vehicle, (the propelling vehicle may advantageously be a tamping machine), which resilient mounting maintains the rail engaging reaction block means slightly clear of the rail heads when the beam is unloaded but collapses upon the application of a lifting load to the beam to permit the reaction block means to engage the rail heads and react to said load.

According to a further feature of the invention, locking means is provided on the propelling vehicle for maintaining the second end of the beam in the lifted position.

According to yet a further feature of the invention, the track position correcting frame comprises a transversely extending member rigidly mounted on the beam member and extending on either side thereof; a floating frame extending transversely of the track beneath the beam member and carried by said transversely extending member; clamp means on said floating frame for clamping it to the tracks; a pair of track lifting piston and cylinder means, each operatively connected at one end to the transversely extending member and the other end to the floating frame. Advantageously, the operative connections between the piston and cylinder means, the transversely extending member and the floating frame, are pivotal connections, to provide for relative movement transversely of the track between floating frame and transversely extending member; a substantially transversely extending track aligning piston and cylinder means being provided, pivoted at one end to an underside of said transversely extending member and at the other end to the floating frame.

A second invention disclosed is a railroad track surface condition referencing device for use with a track jacking machine comprising a rigid and load supporting frame member extending longitudinally of the track to provide a reference datum; a rail sensor for each rail of the track mounted on transversely extending portions of the frame; and means responsive to a rail sensing action of the sensor to provide an indication of that sensing action for track jacking control.

In a first preferred embodiment, the rail sensors are rail head engaging rollers and the means responsive to the rail sensing action of the sensor is merely a visual one when contact is made between the roller and the rail. Between the rollers and the frame, spacer means are provided which may be adjustable.

In a second and third preferred embodiment, guide means are provided which extend substantially parallel to the transversely extending portions of the frame and which are pivotally mounted thereon. Located on the guide means in the second embodiment are mechanical servo valves which act to provide an indication to the operator or a suitable system to terminate jacking action when the servo valves are activated by the sensors which may be rail head engaging rollers. There may also be adjustable spacer means between the guide means and the frame in the second embodiment.

In the third embodiment, the guide means provide for a mechanical linkage system. One aspect of this third embodiment provides a mechanical linkage beginning with the rail sensor and terminating with a movable pointer which moves against a scale fixed to the frame. A second alternative aspect of this third embodiment provides a mechanical linkage beginning with the rail sensor and terminating with a movable scale which may move relative to a pointer fixed to the frame or to a gravity seeking pointer. Spacer means are also provided between the frame and the guide means in the third embodiment.

BRIEF DESCRIPTION OF DRAWINGS

The following is a description, by way of example, of the certain embodiments of the invention, reference being had to the accompanying drawings in which.

DESCRIPTION OF PREFERRED EMBODIMENTS

Figure 1:
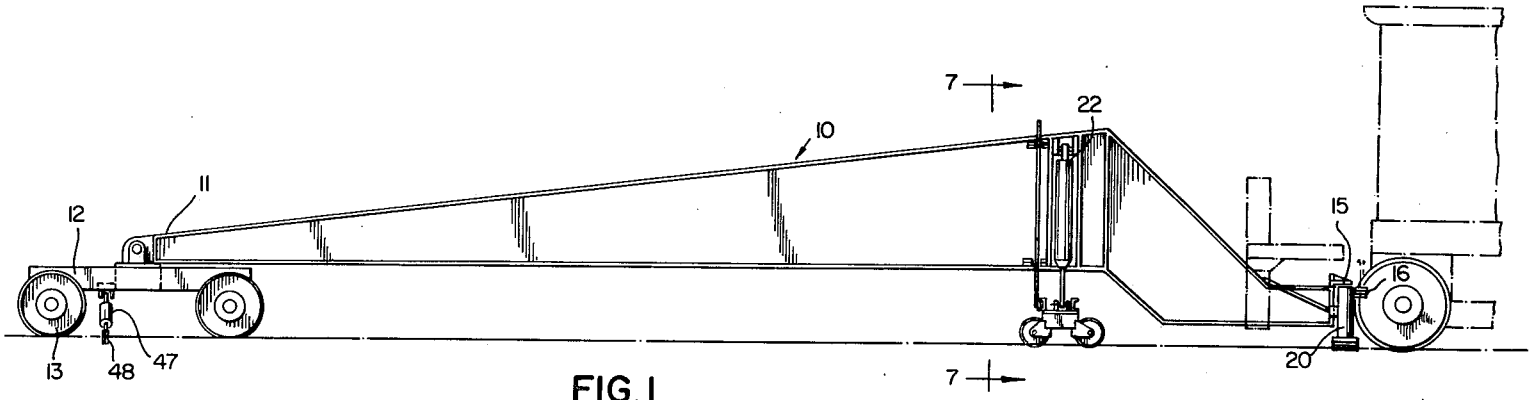
FIG. 1 is a side elevation of the device according to the present invention mounted on a track for track travel.
Figure 2:
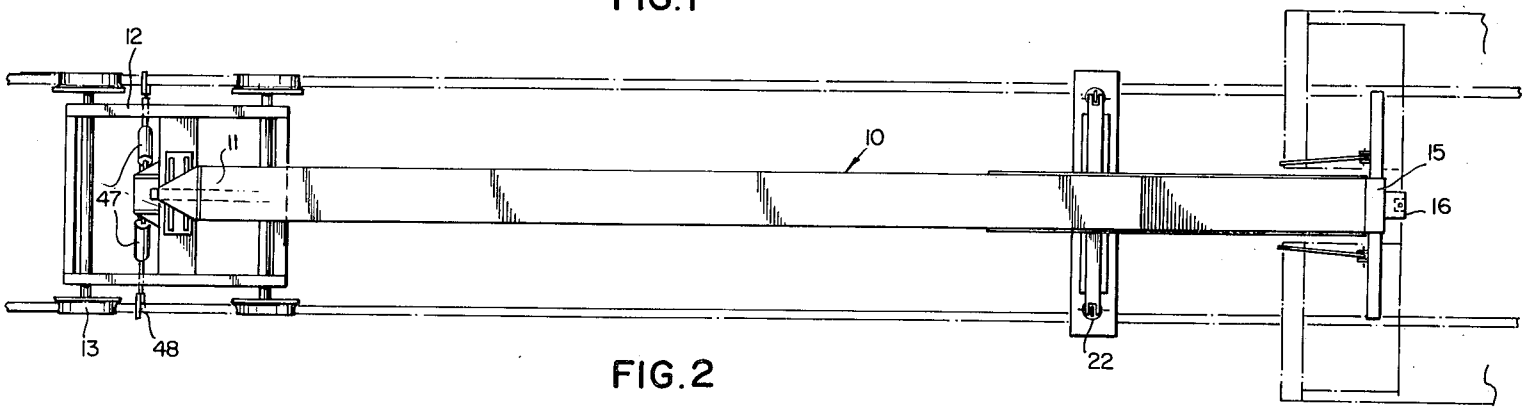
FIG. 2 is a plan view of the device as shown in FIG. 1.

Referring now to the drawings, a beam member 10 extends longitudinally of the track and is mounted at a first end 11 on a truck 12 which carries track engaging wheels 13. A second end of the beam 15 carries connections 16 (best seen in FIG. 3) to connect the beam member to a propelling vehicle. Conveniently the propelling vehicle may be a tamping machine of convention design with its tamping heads (not shown) cantilevered ahead of the front axle of the vehicle. It is to be understood that whilst the present invention finds its most ready application when connected to a tamping machine, it could be also utilized with any form of propelling vehicle where the track tamping operation is performed by hand-held tamping units, provided of course that vehicle had, like a tamping machine, the hydraulic power sources to operate the track correcting frame. Reaction block means 20 are provided in the region of the second end 15 of the beam member and these reaction block means are shown in more detail in FIGS. 3 and 4.

A track position correcting frame 22 is carried by the beam between the reaction block means 20 and the first end 11 of the beam at a point much closer to the reaction block means 20 than to the first end 11. As shown in the drawings, the preferred distance between the correcting frame and the first end, and the correcting frame and the reaction block means, is 3:1. The track correcting frame is seen in more detail in FIGS. 7 and 8.

Figure 3:
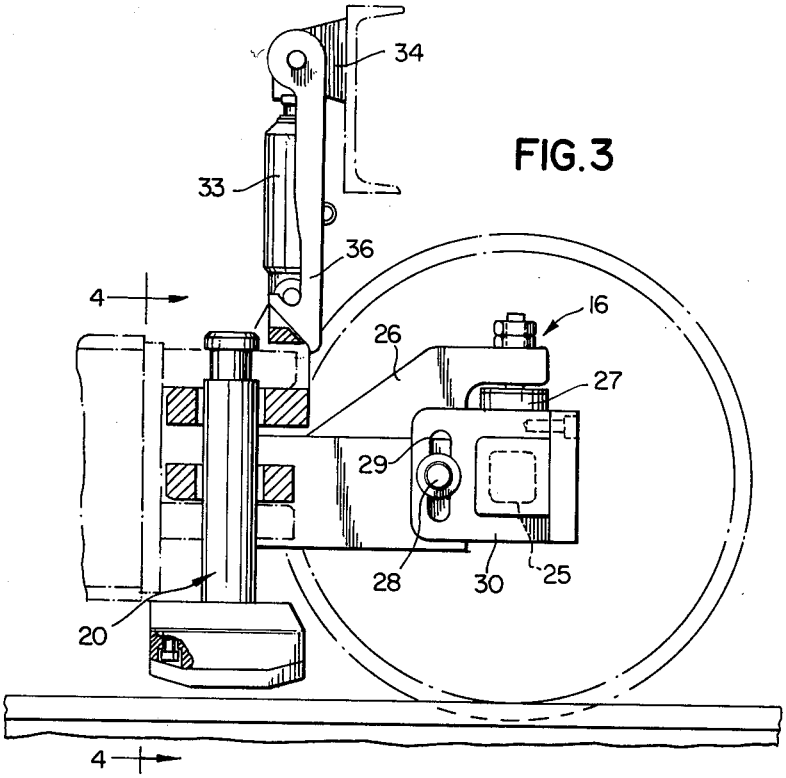
FIG. 3 is a detail in side elevation of reaction block means and connections for the beam to the propelling vehicle.
Figure 4:
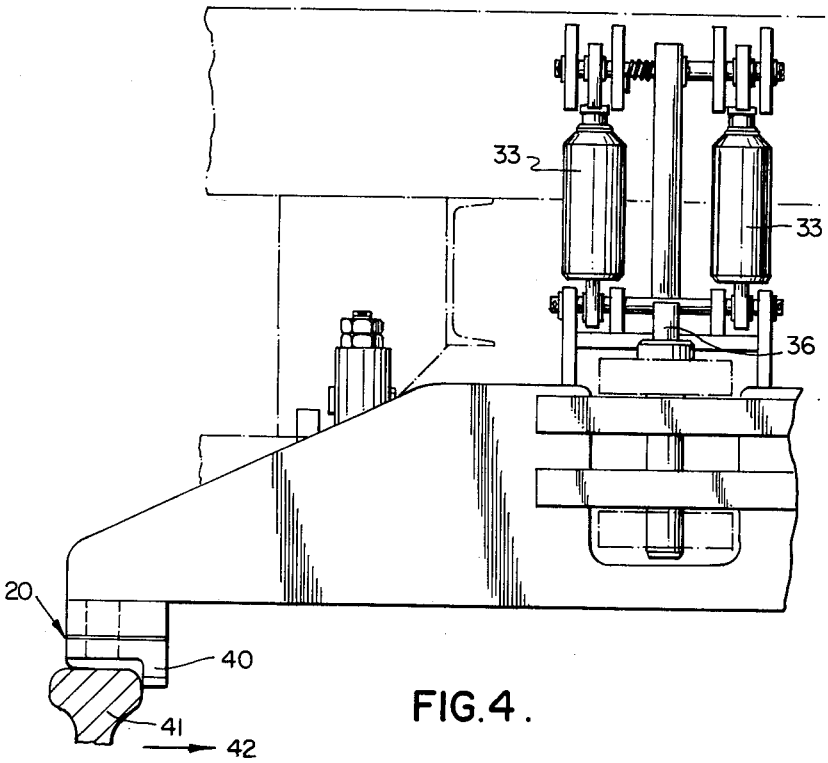
FIG. 4 is a detail of the reaction block means looking in the direction of the arrows 4—4 of FIG. 3.

Referring now more particularly to FIGS. 3 and 4, the end 15 of the beam member is resiliently mounted on the front axle 25 of the propelling machine by means of an attaching lug 26 which is mounted on a rubber spring 27 on the front axle 25. A transversely extending pin 28, in a slot 29 on the frame 30 of the axle 28 permits up and down movement of a limited nature of the end 16 relative to the axle. In FIG. 3 the end 16 is shown mounted for track travel, it being lifted to travel position by hydraulic cylinders 33 mounted on the frame 34 of the propelling vehicle and maintained in the raised position by means of locking hook 36. In this position, the reaction block means 20 are well clear of the track so the propelling vehicle end beam 10 may proceed at track travelling speeds to the operation site.

On reaching the site, the cylinders 33 are further contracted, the locking hook 36 disengaged and the cylinders 33 extended so that the element 26 bottoms on the spring 27, in which position the reaction block means are maintained, provided the beam member 10 is unloaded at a height of about 3/16" above the rail heads.

The reaction block means 20 which includes a pair of blocks, one for each rail head, (see FIG. 4) have flanges 40 which face outwardly of the track and engage the inner sides 41 of the rail head. The distance measured transversely of the track in the direction of the arrow 42 between the outside faces of the flanges of the reaction blocks is preferably 5'6½", that is to say, the guage dimension of normal track measured from the inside flanges of the rail heads. If it is desired to engage the outside flanges of the rail heads in addition to the inside flanges, a modified configuration is required for the engaging surfaces of the blocks, a suitable configuration is seen in U.S. Pat. No. 3,510,106 issued May 5, 1970, inventors H. von Beckmann et al.

Figure 5:
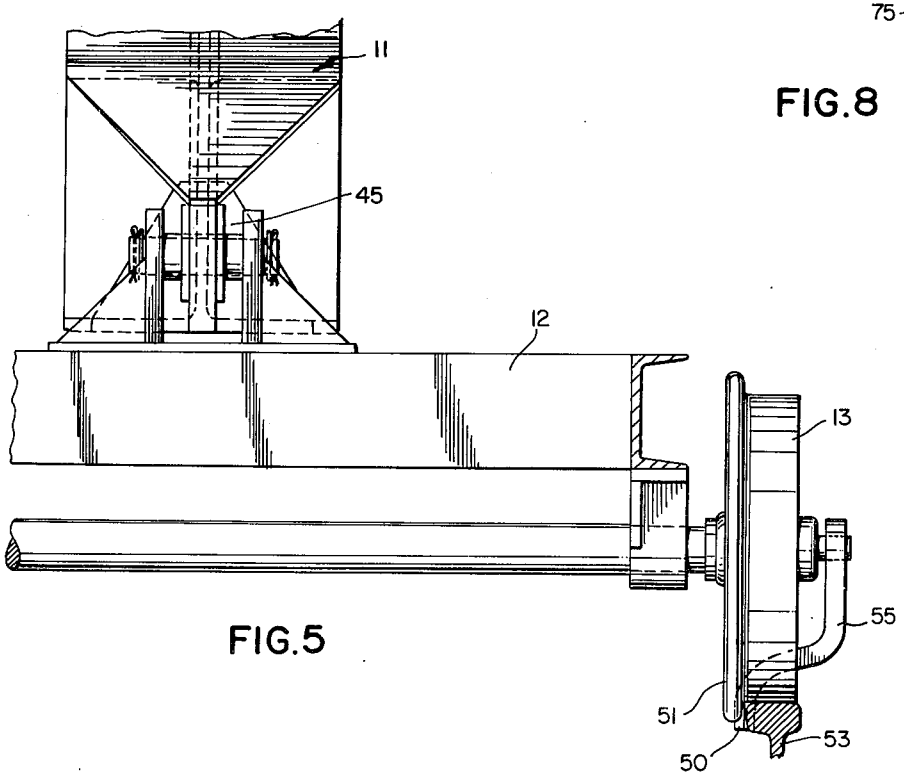
FIG. 5 is a part detail of a truck carrying the front end of the beam.
Figure 6:
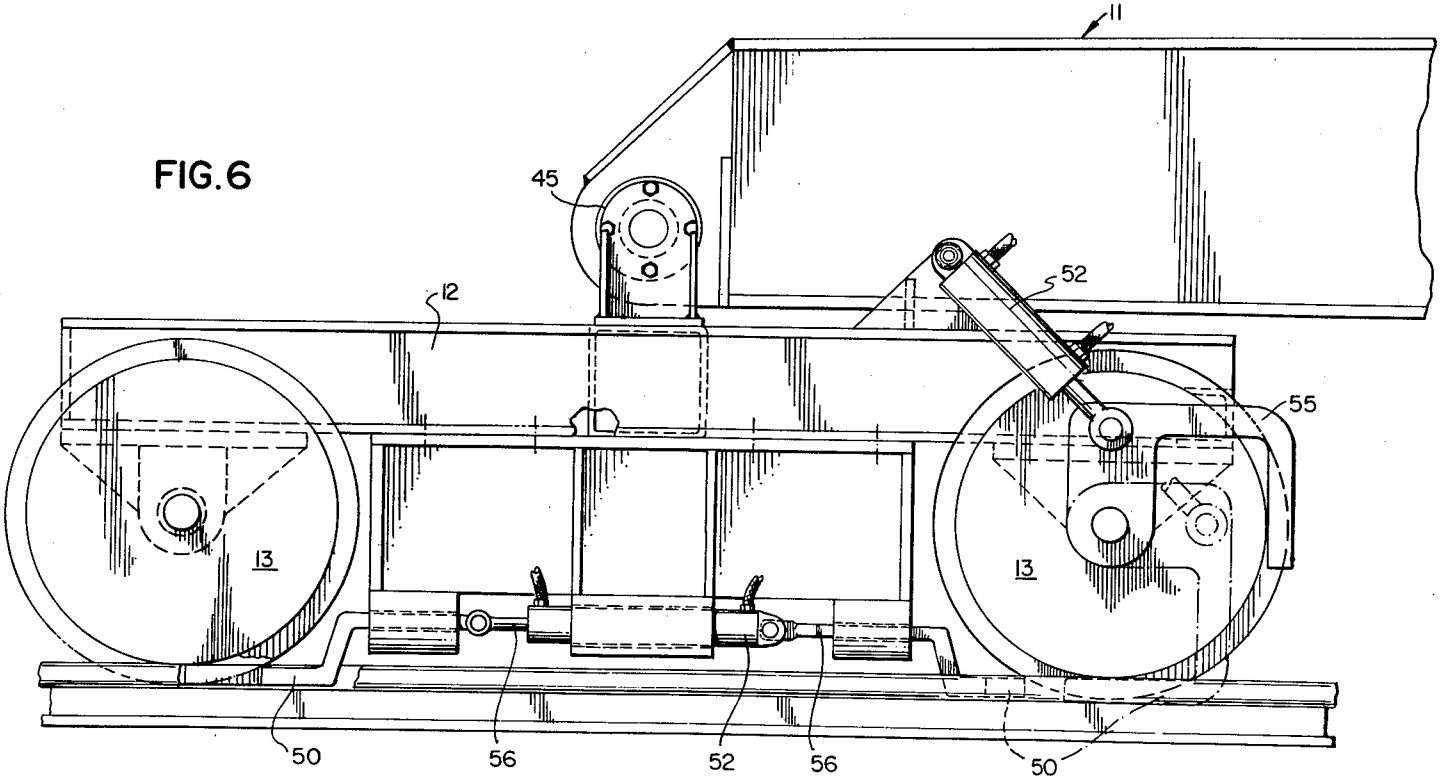
FIG. 6 is a detail in side elevation of the truck, wedging devices for the wheels being shown schematically.

Referring more particularly to FIGS. 5 and 6, the front end 11 is mounted in a pivot bearing 45 to the truck 12 which carries the rail engaging wheels 13. The first end 11 of the beam is preferably clamped to the track during a track correction operation and this clamping can be by means of any suitable device, for example, a pair of downwardly and outwardly extending cylinders 47 as seen in FIG. 1, carrying rail engaging ends 48 which, when the cylinders 47 are operated, extend outwardly and push against each of the rails of the track so as to rigidly maintain the front end 11 clamped to the track; or, alternatively, and preferably, wedging devices (as shown schematically in FIGS. 5 and 6) which are hydraulically operated in known fashion. The wedges 50 which are mounted on either side of the front end 11, are selectably insertable between the flanges 51 of the wheels 13 and the grade rail 53. When the grade rail changes the wedges on the other side of the front end 11 are operated. It will be clear that the wedges shown in FIGS. 5 and 6 are only schematically illustrated and are operable by means of piston and cylinder arrangements 52 to either rotate them on arms 55 as shown in FIGS. 5 or 6, or merely move then longitudinally of the track as shown in FIG. 6 on rods 56 to perform the wedging action.

Figure 8:
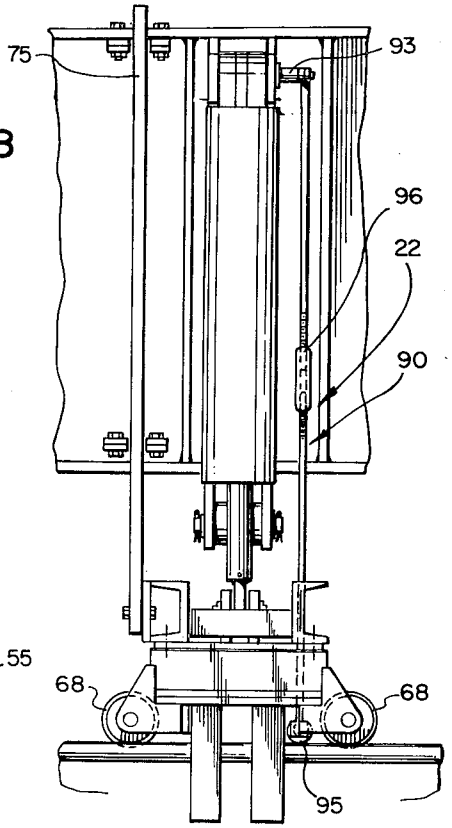
FIG. 8 is a detail in side elevation of the track correcting frame.
Figure 7:
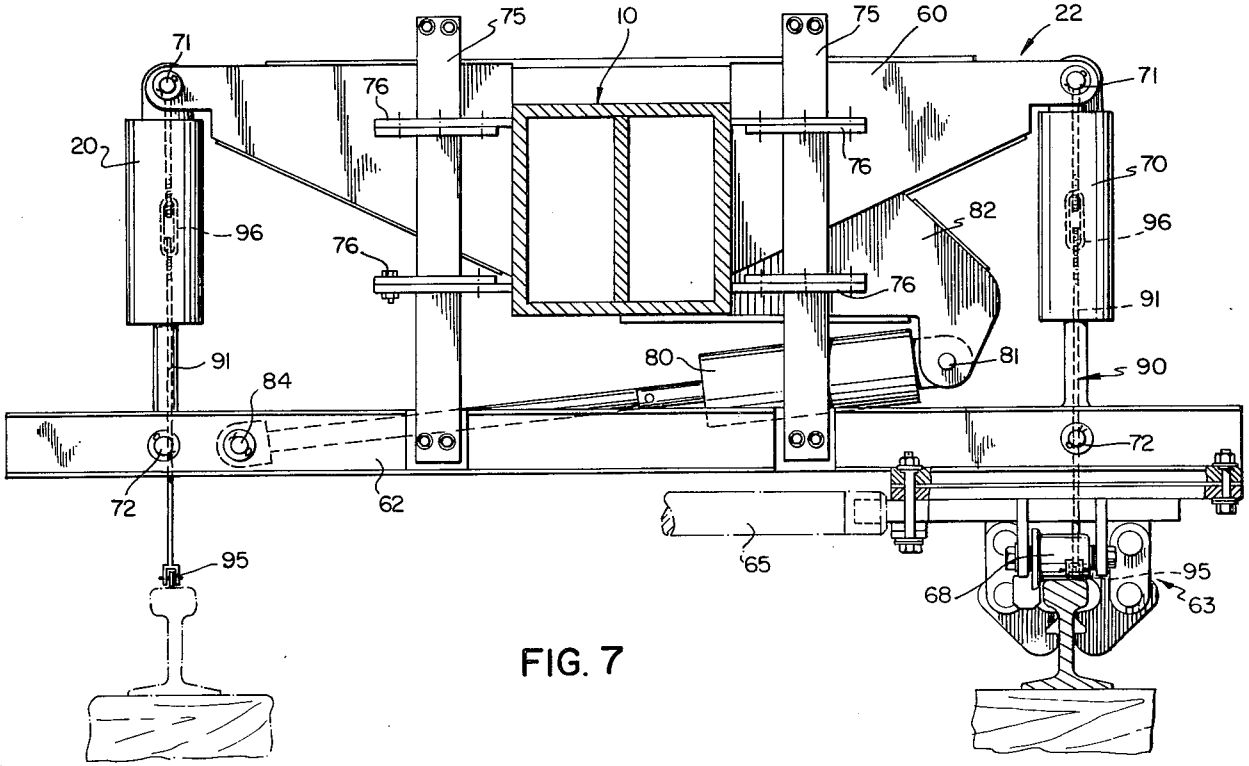
FIG. 7 is a detail of a track correcting frame looking in the direction of the arrows 7—7 of FIG. 1 and showing a first embodiment of the track position reference means.

Referring now more particularly to FIGS. 7 and 8, the track correcting frame comprises a transversely extending member 60 which is rigidly welded to the beam member 10 and extends transversely on either side thereof. Mounted beneath the beam 10 is a floating frame 62 which carries rail engaging clamps 63. The rail engaging clamps 63 may, for operation in regular track conditions be of any conventional desired form and as shown are of the type which are push-pull operated by means of cylinders 65, as described in detail in the aforementioned Stewart U.S. Pat. No. 3,299,833. The floating head is supported on the rail by means of track engaging rollers 68 and is connected to the tranversely extending frame 60 at either side by means of a track lifting piston and cylinder means 70. The piston and cylinder means 70 are operatively connected by means of pivots 71 to the transversely extending frame 60 and at the other ends 72 to the floating frame. The floating frame is further provided with vertical guide rods 75 which slide in transversely slotted guideways 76.

A substantially transversely extending track aligning piston and cylinder means 80 is pivotally connected at 81 to a flange 82 on the underside of the transversely extending member 60 and at its other end at 84 to the floating frame 62.

Again referring to FIGS. 7 and 8, a track position reference means, generally indicated at 90, is provided in the region of the track position correcting frame 22. In one embodiment the track position reference means comprises a pair of depending rod members 91 connected to the transversely extending frame 20 by an extension 93 of the pivot pin at the pivots 71 and extending down into engagement with each rail of the track through a little roller 95. The length of the rods 91 may be variable by means of any suitable device, such as for example, a turnbuckle 96, and may carry a scale so that they can be observed by the operator or may be connected to an electrical system, in known manner, to provide an indication when contact is made by the roller 95 with the top of its respective rail head.

In operation when the beam is at the work site and after the locking hook 36 has been released and the flange 26 engages the rubber spring 27, the required length of the depending rods 91 are adjusted (if the track requires superelevation, obviously the length of one of the rods 91 will be shorter than the other). The track position correcting frame 22 is positioned over a point of the track which requires correction and the clamps 63 are applied to clamp the floating frame 62 to the rails. Admission of hydraulic fluid to the cylinders 70 causes the raising of the track and the reaction to this lifting load is taken at the front end on the truck 12 through the pivot bearing 45 and momentarily at the front axle 25 through the spring 27, the flange 26 bearing thereon and the pin 28 sliding downwardly in the slot 29. As soon as the reaction blocks 20 engage the rail heads further lifting force applied by the piston and cylinder jacks 70 is transmitted directly to the rail heads through the reaction blocks 20. With this arrangement any suitable allowable portion of the reaction forces, say about 5%, are borne by the axle prior to the engagement of the reaction block means. This amount of force is a perfectly acceptable loading for the axle. It is to be understood, of course, that if desired, the rubber spring configuration 27 could be replaced by making the reaction block means themselves extendable into contact with the rail prior to any lifting force whatsoever being applied to the beam. Indeed, the beam could be mounted in such a fashion that it is merely pushed along the track to an operative position and there automatically, hydraulically lowered into track contacts on the reaction block means prior to a lifting or lining operation. No reaction forces whatsoever would then be passed to the pushing vehicle. The presently illustrated arrangement is preferred only for its simplicity and cheapness and because the loading of the front axle bearing in the configuration shown is perfectly acceptable.

Since the reaction block means 20 are very much closer to the track correcting frame 22, than is the truck 12, the lifting load on the track through the reaction blocks 20 is of the order of three times that which is borne at the first end 11. For this reason, the mounting of the wheels 13 on the truck 12 can be conventional since the forces transmitted by the wheels 13 to the track are completely within the loading limits accepted for axles of this type. Lifting of the track by means of the cylinder 70 is continued until the rods 91 of the reference system either visably indicate that the rail has been lifted up into contact with the roller 95, or an electrical signal generated by the contact of the rail head with the roller 95 terminates, in standard fashion, the jacking action of the associated piston and cylinder means 70.

In order to perform a track aligning operation, it is preferable that the truck 12 be clamped firmly to the rails and this is suitably accomplished by moving the wedges 50 in between the flanges 51 of the wheels of the truck which engage the grade rail and the inside head of the grade rail itself 53. Since the spacing between the faces 41 of the flanges 40 of the reaction block means 20 corresponds to the track guage, these flanges 41 fit snugly with the inside of the rail heads. Operation of the track aligning piston and cylinder device 80 to extend or contract the jack thereof will push or pull the pivot point 84 away from or towards the pivot point 81 and will thus move the track in either direction. The guides 75 move transversely in their ways 76. Again the aligning forces are borne, in the main, by the reaction block means 20 and the wedged wheels, and there is virtually no transmission of alignment forces to the front axle of the propelling vehicle through the rubber block.

Any suitable track position reference means may be utilized with the device of the present invention, and if desired the cylinders 70 and 80 can be automatically sequenced so that the track is lifted very slightly in order to loosen its position in the track bed prior to the operation of the cylinder 80 to perform a lining operation.

Figure 9:
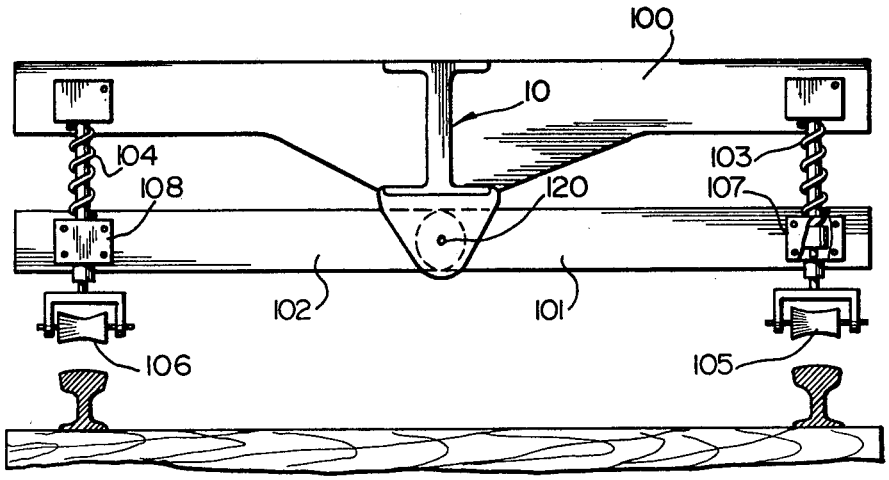
FIG. 9 is a front elevation view of a detail of a second embodiment of the track position reference means.

Referring to FIG. 9, a further embodiment of the track position reference means is shown. Transversely extending rigid frame 100 is connected to the longitudinally extending beam member 10 and provides support for extending arms or guide means 101, 102 which are connected to the frame 100, through pivotal connection 120. Physical connectors or spacer means 103, 104 provide vertical adjustment for the guide means 101, 102 and, accordingly, for sensors 105, 106 which each take the form of a rail head engaging roller adapted to contact the track. Mechanical servo valves 107, 108 are mounted on the guide means, the servos acting when the rail head engaging roller contacts the rail being lifted or tamped to send an appropriate signal to inform the operator or to signal an appropriate control circuit to terminate the jacking operation.

Figure 10:
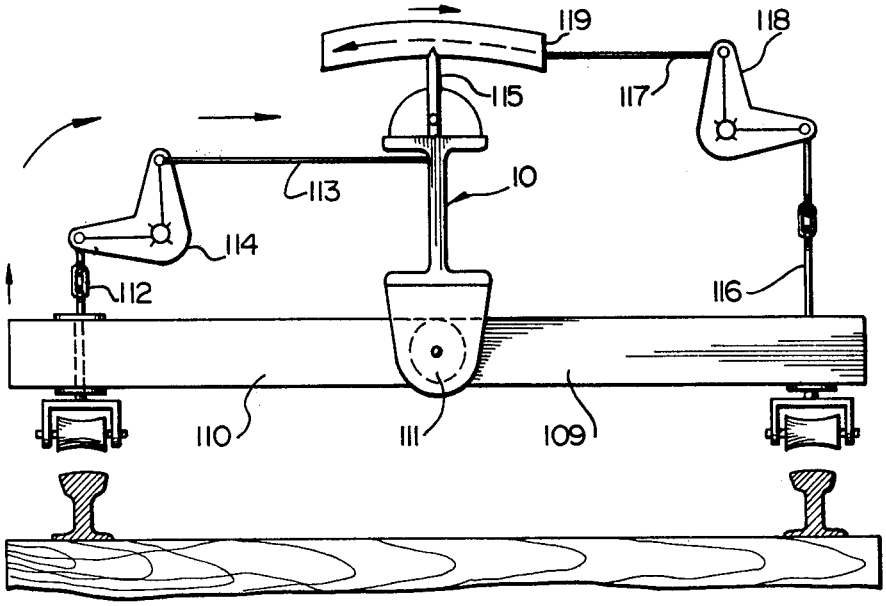
FIG. 10 is a front elevation view of a detail of yet a third embodiment of the track position reference means.

FIG. 10 shows a further two embodiments of the track position reference means. In the first of the two further embodiments, a scale 119 is fixed to the frame (not shown) while adjustable mechanical linkages 112, 114, 113 which are connected to pointer 115 move in response to movement of the rail engaging roller 106, thereby indicating the position of the track relative to the frame. In the second of the two further embodiments, a scale 119 is movable through mechanical linkage 116, 118, 117. A pointer 115 may be fixed to the frame to provide an indication of scale displacement or a gravity seeking pointer (not shown) may be provided. The use of the movable scale would be conveniently used when one rail was in a superelevated position relative to the other rail or when the road bed was curved.

It may be necessary, however, when there has been an accumulation of track error through repeated track adjustments, to readjust the reference means and thereby obtain a new corrected position. To enable this to be achieved, the override device may be inserted in the hydraulic servo circuit used to trigger a lifting cutoff (FIG. 9), the override device being manually operated by the machine operator. When the mechanical circuit (FIG. 10) is used to show visually when the lifting should be terminated, either the turnbuckles 112, the reference scale 119, or the reference pointer 115 may be displaced an appropriate distance corresponding to the accumulated error. Accordingly, a new corrected zero reference position will be obtained.

When the track is in the corrected position, it can be tamped therein by means of tamping heads on the tamping machine in known fashion or it can be hand tamped.

Clearly, modifications may be made to the embodiments described within the spirit of the invention. For example, the rail head engaging rollers are only one of several possible configurations for the sensors and the signalling means may be optical, electrical, or mechanical and may act to terminate the jacking operation or to notify the machine operator of rail contact. Accordingly, the invention should be limited only by the scope of the appended claims.

What we claim as our invention is:

1. A device for lifting and aligning a railroad track, said device comprising a beam member for extending longitudinally of the track and having track engaging wheels mounted at a first end of said beam member and a pair of reaction blocks, one for each rail, on said beam member in the region of the second end of said beam member, each reaction block having a laterally facing flange for engaging a side of a rail head; a track position correcting frame, including means for laterally shifting the track, carried on said beam member between said reaction blocks and said first end and closer to said reaction blocks than to said first end; and means to connect said second end of said beam member to a propelling vehicle and including a mounting for said second end of said beam member adapted to maintain the rail engaging reaction blocks slightly clear of the rail heads when the beam member is unloaded and which permits the reaction blocks to engage the rail heads to react to an applied load.

2. A device as claimed in claim 1 in which said flanges on said reaction blocks face outwardly of the railroad track and engage the inner side of a rail head.

3. A device as claimed in claim 1, in which said mounting is a collapsible resilent mounting.

4. A device as claimed in claim 1 in which the distance measured transversely of the track, between the rail engaging faces of said flanges is related to the track gauge.

5. A device as claimed in claim 1 in which a track position reference means is provided in the region of the track position correcting frame.

6. A device for lifting and aligning railroad track comprising a beam member for extending longitudinally of the track, mounted at a first end on track engaging wheels; a second end of said beam being adapted to connect to a propelling vehicle; reaction block means on said beam member in the region of said second end; a track position correcting frame carried by said beam between said reaction block means and said first end and means to clamp the first end of the beam to the track during a track correction operation.

7. A device as claimed in claim 6 in which the means to clamp the first end of the beam to the track comprises wedge means insertable between at least one selected flange of said track engaging wheels and the inside of a corresponding rail head.

8. A device as claimed in claim 7 in which the first end of the beam member is mounted on a truck which carries said track engaging wheels, the wedge means being operatively mounted on said truck; and power means being provided for selectably activating said wedge means.

9. A device for lifting and aligning railroad track comprising a beam member for extending longitudinally of the track, mounted at a first end on track engaging wheels; a second end of said beam being adapted to connect to a propelling vehicle; reaction block means on said beam member in the region of said second end; a track position correcting frame carried by said beam between said reaction block means and said first end; and a resilient mounting for connecting the second end of said beam member to the front axle of said propelling vehicle, which resilient mounting is adapted to maintain the rail engaging reaction block means slightly clear of the rail heads when the beam is unloaded but collapses upon the application of a lifting load to the beam to permit the reaction block means to engage the rail heads and react to said load.

10. A device as claimed in claim 9 in which locking means is provided on the propelling vehicle for maintaining said second end in the lifted position.

11. A device for lifting and aligning railroad track comprising a beam member for extending longitudinally of the track, mounted at a first end on track engaging wheels; a second end of said beam being adapted to connect to a propelling vehicle; reaction block means on said beam member in the region of said second end; and a track position correcting frame carried by said beam between said reaction block means and said first end, which track position correcting frame comprises a transversely extending member, rigidly mounted on said beam member and extending on either side thereof; a floating frame extending transversely of the track beneath the beam member and carried by said transversely exteing member; clamp means on said floating frame for clamping it to the track; a pair of track lifting piston and cylinder means each operatively connected at one end to the transversely extending member and at the other to the floating frame.

12. A device as claimed in claim 11 in which the operative connections between the piston and cylinder means, the transversely extending member and the floating frame are pivotal connections, to provide for relative movement transversely of the track between floating frame and transversely extending member, and in which a substantially transversely extending track aligning piston and cylinder means is pivoted at one end to an underside of said transversely extending member and at the other end to the floating frame.

13. A device as claimed in claim 11 in which a track position reference device is connected to the transversely extending member for referencing engagement with the track.

14. A device as claimed in claim 13 in which the track position reference device includes a pair of depending rod members of adjustable length, one rod member being connected to the transversely extending member over each rail.

15. A railroad track surface condition referencing device for use with a track jacking machine comprising a rigid and load supporting frame member extending longitudinally of the track to provide a reference datum; a rail sensor for each rail of the track mounted on said frame; and means responsive to a rail sensing action of the sensor to provide an indication of that sensing action for track jacking control.

16. A device as claimed in claim 15 in which spacer means are provided between said frame and said sensors, said spacer means being adjustable between said frame and said sensor.

17. A device as claimed in claim 16 in which said spacer means are physical connections between said frame and said sensors.

18. A device as claimed in claim 17 in which said means responsive to a rail sensing action is adapted to generate a signal for termination of the upward jacking of the rail being sensed.

19. A device as claimed in claim 18 in which said sensor includes a rail head engaging roller.

20. A device as claimed in claim 15 in which portions of said frame extend above each rail; guide means are connected to said frame and carry, for each rail, a rail sensor; and spacer means for each of said sensors connect said frame portions and said guide means.

21. A device as claimed in claim 20 in which said guide means comprises a pair of transversely extending arms pivotally connected inwardly of the rails to said frame and attached in the vicinity of their outer ends to the frame by means of said spacer means.

22. A device as claimed in claim 21 in which said rail sensor includes a mechanical servo valve mounted on said transversely extending arms and said spacer means are adjustable.

23. A device as claimed in claim 22 in which said rail sensor includes a rail head engaging roller and an actuator for operating the valve means.

24. A device as claimed in claim 21 in which the means responsive to the rail sensing action is a pointer connected by an adjustable length linkage to one of said sensors, said indication being a visual one provided by movement of said pointer against a scale mounted to said frame.

25. A device as claimed in claim 21 in which the means responsive to the rail sensing action is a movable scale connected by an adjustable length. linkage to one of said sensors, said indication being a visual one provided by movement of said scale against a pointer mounted to said frame.

26. A device as claimed in claim 25 in which a second gravity seeking pointer is mounted on said frame to provide a zero reference point against said scale.

* * * * *